United States Patent [19]

Hirota et al.

[11] Patent Number: 5,072,502

[45] Date of Patent: Dec. 17, 1991

[54] METHOD AND APPARATUS FOR APPLYING SLIDE FASTENER END STOP

[75] Inventors: Minoru Hirota, Uozu; Kazuki Kuse, Toyama; Keiichi Keyaki, Kurobe, all of Japan

[73] Assignee: Yoshida Kogyo K. K., Tokyo, Japan

[21] Appl. No.: 691,436

[22] Filed: Mar. 25, 1991

[30] Foreign Application Priority Data

| | | | |
|---|---|---|---|
| Apr. 27, 1990 | [JP] | Japan | 2-110099 |
| Jun. 21, 1990 | [JP] | Japan | 2-161292 |
| Jan. 22, 1991 | [JP] | Japan | 3-81069 |

[51] Int. Cl.[5] ..... A41H 37/06; B21D 53/52

[52] U.S. Cl. ..... 29/408; 29/767

[58] Field of Search ..... 29/408, 409, 410, 766–769, 29/33.2

[56] References Cited

U.S. PATENT DOCUMENTS

| | | | |
|---|---|---|---|
| 2,242,967 | 5/1941 | Carlile | 85/49 |
| 2,384,145 | 9/1945 | Voity et al. | 29/409 |
| 2,523,388 | 9/1950 | Katzke et al. | 29/767 |
| 3,530,563 | 9/1970 | Maeda | 29/207.5 |
| 3,755,879 | 9/1973 | Cuckson | 29/408 |
| 3,792,521 | 2/1974 | Kawakami | 29/768 |
| 4,985,977 | 1/1991 | Osaki | 29/408 |
| 5,007,161 | 4/1991 | Matsuda | 29/410 |

FOREIGN PATENT DOCUMENTS

| | | | |
|---|---|---|---|
| 70428 | 1/1942 | Czechoslovakia | 29/408 |
| 45-16624 | 6/1970 | Japan . | |

*Primary Examiner*—P. W. Echols

*Attorney, Agent, or Firm*—Hill, Van Santen, Steadman & Simpson

[57] ABSTRACT

A method of and an apparatus for feeding and applying end stops one at a time onto a slide fastener chain are disclosed. An elongated strip wound on a reel and carrying a multiplicity of prospective end stops serially interconnected by flexible connecting cords is cut successively across the cords to separate a leading end stop which is folded centrally about its transverse axis. The thus cut end stop is transferred onto and clamped in place over a beaded edge of a stringer tape with heat and pressure.

6 Claims, 8 Drawing Sheets

METHOD AND APPARATUS FOR APPLYING SLIDE FASTENER END STOP

BACKGROUND OF THE INVENTION

1. Field of the Invention

This invention relates to a method of and apparatus for applying end stops to slide fasteners and more particularly to such method and apparatus for selectively applying top end stops one at a time from a strip containing a succession of serially interconnected prospective end stops.

2. Prior Art

End stops made of a synthetic plastic material and having different styles and colors are well known as a means of restricting the movement of a slider on a slide fastener. A multiplicity of end stops are supplied from a parts feeder such as a hopper and fed through a chute connected to the parts feeder to an applying station at which the end stops are applied one at a time to an end portion of the slide fastener. When it is desired to change or switch between one batch of end stops of a given style or color and another batch of a different style or color, it was necessary to evacuate the parts feeder and the chute for replacement of the end stops. Alternatively, it was necessary to provide a plurality of parts feeders and chutes to cope with the switching operation, which would literally require increased floor space in the manufacturing facilities of slide fasteners. It was thus inefficient, if not difficult, with the conventional practice to selectively feed and apply slide fastener end stops of varying characters.

SUMMARY OF THE INVENTION

It is therefore a primary object of the present invention to provide a method of feeding and applying slide fastener end stops selectively with maximum efficiency and accuracy.

It is another object of the invention to provide an apparatus which will carry the above method into practice and which is relatively simple and compact in construction.

Briefly stated, the method of the invention comprises the steps of winding upon a cartridge-type reel an elongated strip formed from a synthetic plastic material and having a succession of serially interconnected prospective end stops and a plurality of flexible connecting cords interconnecting adjacent ones of the end stops in spaced apart relation; advancing the strip by a pitch corresponding to one of the end stops; cutting a leading one of the end stops from the strip across the connecting cords; folding the thus cut leading end stop centrally about its longitudinal axis; transferring the thus folded leading end stop to an end stop applying station; and clamping the same astride over one longitudinal edge of a slide fastener tape.

The apparatus of the invention comprises: a reel stocker unit including at least one reel having wound thereon an elongated strip formed from a synthetic plastic material and having a succession of serially interconnected prospective end stops and a plurality of flexible connecting cords interconnecting adjacent ones of the end stops in spaced apart relation; a reel stocker releasably mounting the reel thereon and having a vertical guide channel for the passage of the strip; a reel stocker holder releasably holding the reel stocker thereon and movable horizontally reciprocally toward and away from a predetermined position; a transfer table unit including a table having a vertical guide slit dimensioned to receive one end stop from the reel stocker and a horizontal guide groove communicating with the guide slit and extending longitudinally of the table; a transfer finger reciprocally movable horizontally to engage the connecting cords of the strip and vertically to bring a leading end stop onto the table; a cutter movable reciprocally horizontally for cutting off the leading end stop across the connecting cords; and a pusher movable reciprocally horizontally in and along the guide groove and adapted to cause the leading end stop to fold about its longitudinal axis; a parts applying unit including a parts holder movable arcuately toward and away from the path of the slide fastener chain and having a pocket for receiving the end stop, which has been folded, from the table and transfering the same onto the slide fastener chain; and a means of clamping the folded end stop onto a beaded edge of a slide fastener tape with heat and pressure.

The above and other objects and features of the invention will appear manifest from reading the following detailed description taken in conjunction with the accompanying drawings which illustrate by way of example some preferred embodiments.

DETAILED DESCRIPTION OF THE INVENTION

Figure 11:
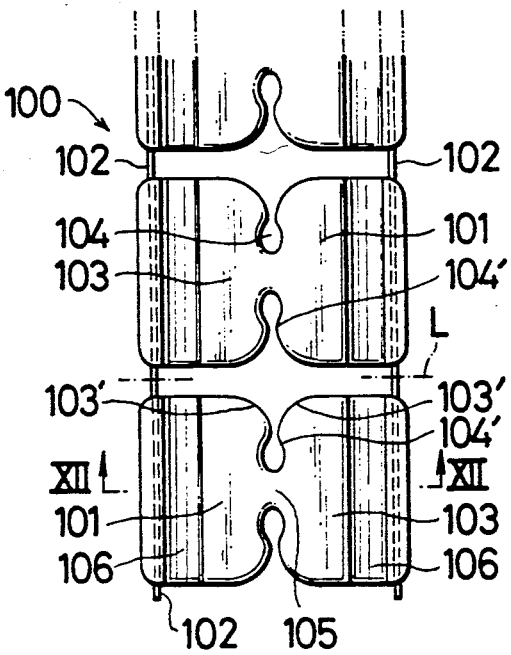
FIG. 11 is a fragmentary plan view on enlarged scale of a strip having a succession of serially interconnected end stops.
Figure 15:
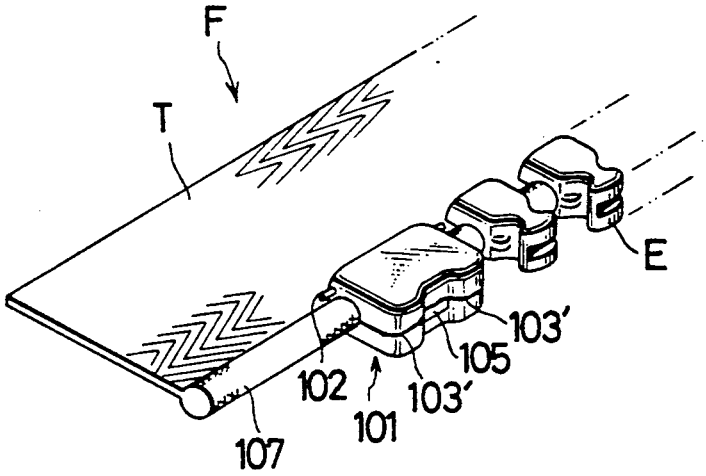
FIG. 15 is a fragmentary perspective view on enlarged scale showing the end stop attached to an end portion of the stringer tape.

Referring to the drawings and firstly FIG. 11, there is shown an elongated strip 100 formed from a synthetic plastic material and having a succession of serially interconnected prospective end stop members 101, which strip is the subject-matter described and claimed in Japanese Patent Application No. 2-110099 assigned to the present assignee. Adjacent end stop members 101 are spaced apart by a small distance and interconnected by a pair of flexible connecting cords 102 such as of a textile yarn thread, a synthetic plastic monofilament or other flexible or pliable materials, the cords 102 extending in parallel longitudinally through opposite outer edges of the strip 100. Each of the prospective end stop members 101 has a pair of identical legs 103, 103 which are adapted to fold across the width of the strip 100 in a manner hereinafter described. Each end stop member 101 is notched from opposite ends along a central longitudinal line of the strip 100 to provide a pair of inwardly expanded oblong bights 104 confronting each other across a bridge 105 formed centrally between the legs 103, 103. The edges 104' of each bight 104 merge with rounded-off inner peripheral edges 103', 103' of the respective legs 103, 103. The bridge 105 is reduced in thickness as better shown in FIG. 12 to serve as a hinge about which the end stop member 101 can be accurately and easily folded to bring the two legs 103, 103 in superimposed relation for mounting astride of a tape edge as depicted in FIG. 13, in which instance the rounded peripheral edges 103', 103' of the legs 103, 103 protrude outwardly beyond the bridge 105 as shown in FIG. 15.

Figure 12:
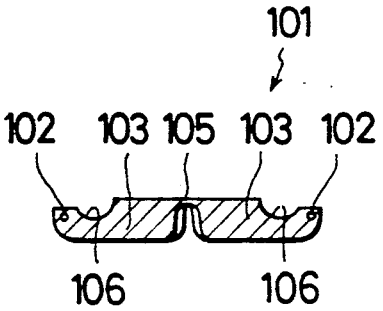
FIG. 12 is a cross-sectional view taken on the line XII—XII of FIG. 11.
Figure 13:
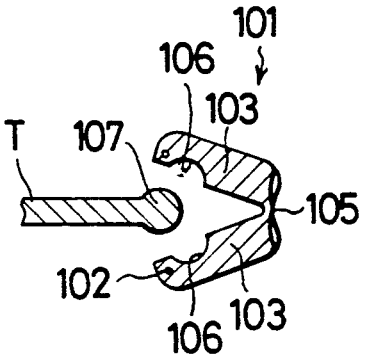
FIG. 13 is a cross-sectional view of an individual end stop showing the same folded for attachment onto a slide fastener type.

As better shown in FIG. 12, the legs 103, 103 of the end stop member 101 each have an arcuate groove 106 extending adjacently along their respective outer longitudinal edges and configured to fit snugly over a beaded edge 107 of a slide fastener stringer tape T which is usually cross-sectionally round.

The elongated end stop forming strip 100 thus constructed is cut transversely along a line L extending transversely across the connecting cords 102 between adjacent prospective end stop members 101 to provide an individual end stop 101. This end stop 101 is shown attached with heat and pressure as by means of the arrangement of a supersonic horn 109 and an anvil 200 schematically shown in FIG. 14 onto a top end portion of a slide fastener stringer F which as shown in FIG. 15 comprises a support tape T and a row of coupling elements E secured thereto.

The end stops 101 carried on the strip 100 of the above construction are fed and applied to a slide fastener stringer F by the method of the present invention which comprises the steps of winding an elongated strip 101 having a succession of serially interconnected prospective end stops upon a cartridge-type reel; advancing the strip 100 by a pitch corresponding to one of the end stops 101; cutting a leading one 101*a* of the end stops 101 from the strip 100; folding the thus cut leading end stop 101*a* centrally about its transverse axis; transferring the thus folded leading end stop 101*a* to an end stop applying station; and clamping the same astride over one longitudinal edge 107 of a slide fastener tape T.

Figure 1:
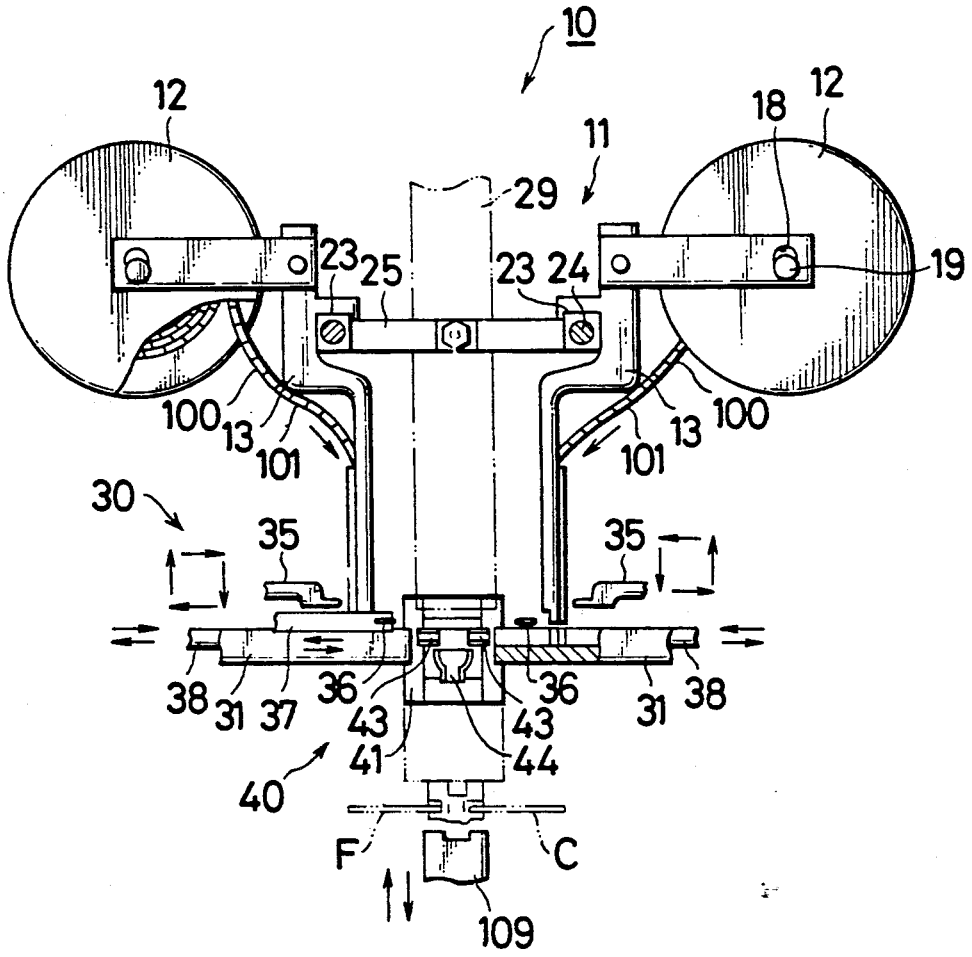
FIG. 1 is a diagrammatic front elevational, partly sectional, view of an apparatus according to a preferred form of the invention.

Turning now to FIG. 1, there is shown an apparatus 10 which reduces the above method to practice and which essentially comprises a reel stocker unit 11, a transfer table unit 30 and a parts applying unit 40.

Figure 3:
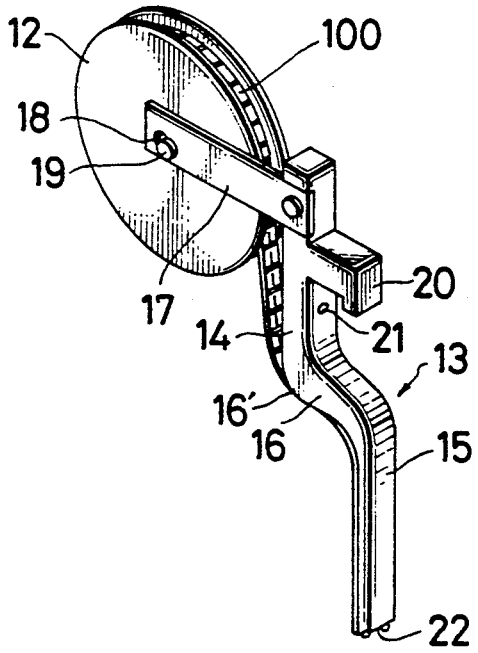
FIG. 3 is a perspective view of a stocker constituting part of the apparatus of FIG. 1.

The reel stocker unit 11 includes a plurality of reels 12 each having wound thereon a length of elongated strip 100 having a multiplicity of serially interconnected prospective end stops 101 which are presently illustrated as ones for attachment to a top or upper end of a slide fastener stringer F and a reel stand or stocker 13 on which the reel 12 is releasably mounted. The reel stocker 13, as better shown in FIG. 3, includes an upper vertical leg portion 14 and a lower vertical leg portion 15 connected integrally thereto by a horizontal portion 16 having a strip guide surface 16'. Connected at one end to and extending horizontally from the upper vertical portion 14 of the stocker 13 is a bracket 17 having an aperture 18 in the opposite end for receiving a reel shaft 19 of the reel 12. The stocker 13 further includes a hook portion 20 extending horizontally from the upper leg portion 15 in a direction opposite to the bracket 17. A spring-biased check ball 21 is provided on the upper leg portion 15 below the hook portion 20. The lower leg portion 15 is made hollow to define a guide channel 22 through which the strip 100 passes to transfer the prospective end stops 101 one at a time in timed response to the cycle of operation of the apparatus 10 which is hereafter described.

Figure 2:
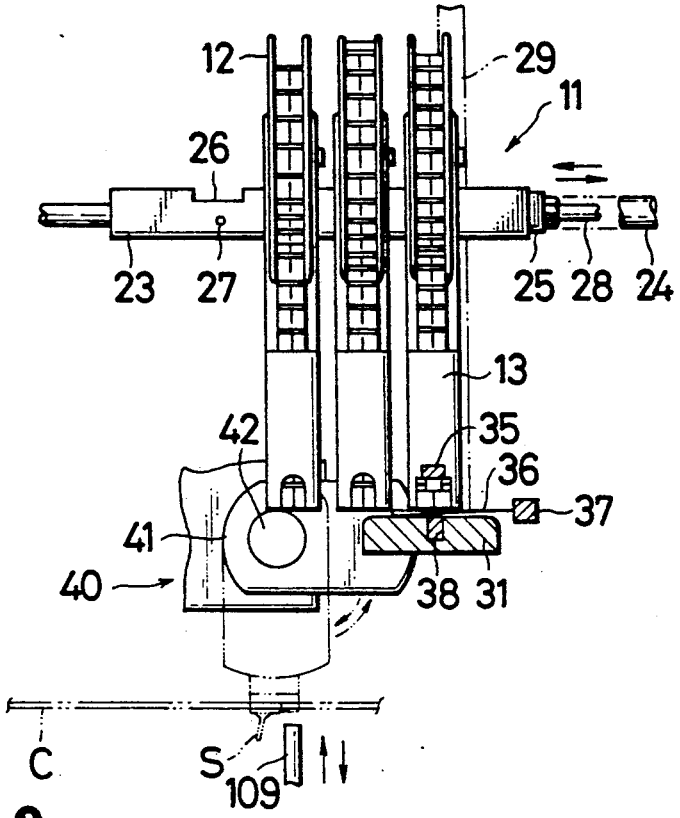
FIG. 2 is a diagrammatic side elevational, partly sectional, view of a portion of the apparatus of FIG. 1.

Designated at 23 and as shown in FIGS. 1 and 2 there are a pair of reel stocker holders 23 which are connected by a transverse beam 25 for releasably holding the reel stockers 13 symmetrically in horizontally spaced parallel relation to define therebetween a space for installing a slider supply chute later described and which are mounted slidably on respective guide rods 24, 24 and movable therealong in a direction parallel to the path of a stringer chain C. Each of the stocker holders 23, 23 is provided in its upper surface with a plurarity of grooves 26 each for receiving the hook portion 20 of the respective reel stocker 13 and in one of its side surfaces with a plurality of dimples 27 each for receiving the check ball 21 of the stocker 13, so that the stocker 13 can be snapped into fitting engagement with corresponding stocker holder 23.

The stocker holders 23 are arranged to move reciprocally along the guide rods 24 by means of a piston rod 28 of a pneumatically actuated cylinder not shown which is operatively connected to the transverse beam 25 as shown in FIG. 2. They reciprocate toward and away from the transfer table unit 30 so to bring thereonto a selected one of the reel stockers 13 in a manner hereafter to be described.

In the illustrated embodiment of the invention, the stocker holders 23 are spaced apart to accommodate therebetween a slider supply chute 29 indicated by phantom lines in FIG. 1 for supplying sliders S for application concurrently with the end stops 101 to the slide fastener chain C but may be brought closer to each other, if the slider attachment is omitted, so as to make the apparatus more compact.

Figure 4:
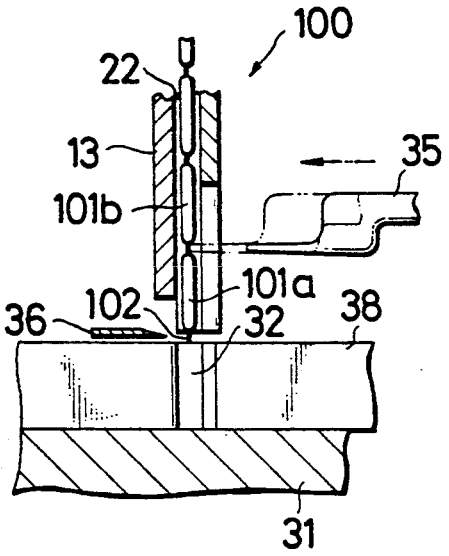
FIG. 4 is a diagrammatic view illustrating the step of feeding end stops in an interconnected row from the stocker of FIG. 3 to a feed table.
Figure 5:
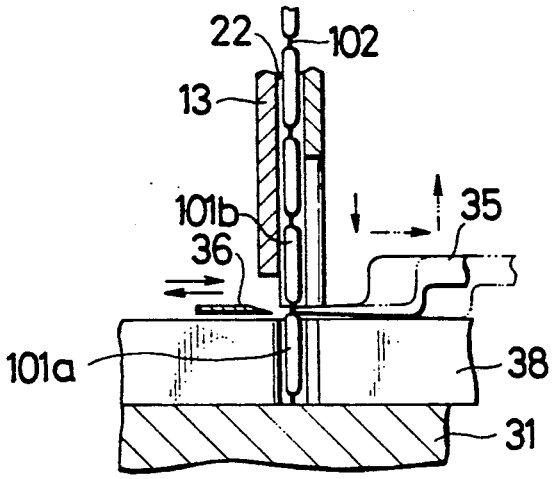
FIG. 5 is a diagrammatic view illustrating the step of cutting one of the end stops on the table.

The transfer table unit 30 includes a pair of transfer tables 31, 31 for transferring the end stops 101 from the reel stockers 13 to the parts applying unit 40, the transfer tables 31, 31 being located in symmetrically opposed relation across the path of stringer chain C, i.e. the position of a parts applying holder later described. Each of the tables 31, 31 has a vertical guide slit 32 dimensioned to receive one end stop 101 in vertically depending posture from the reel stocker 13 and communicating with a horizontal guide groove 33 extending centrally longitudinally of the table 31. The guide slit 32 has a width corresponding to that of the end stop 101 and is contiguous to a guide wall 34 tapering toward an outlet end 31*a* of the table 31. The end stops 101 in the strip 100 are transferred one at a time from the reel stocker 13 by means of a transfer finger 35 which is movable horizontally as well as vertically with respect to the table 31 as shown in FIGS. 4 and 5. The transfer finger 35 moves horizontally toward the reel stocker 13 and engages the connecting cords 102 of the strip 100 as shown in FIG. 4, followed by its downward movement to bring a leading end stop 101*a* down onto the table 31 through the guide slit 32 as shown in FIG. 5.

Figure 6:
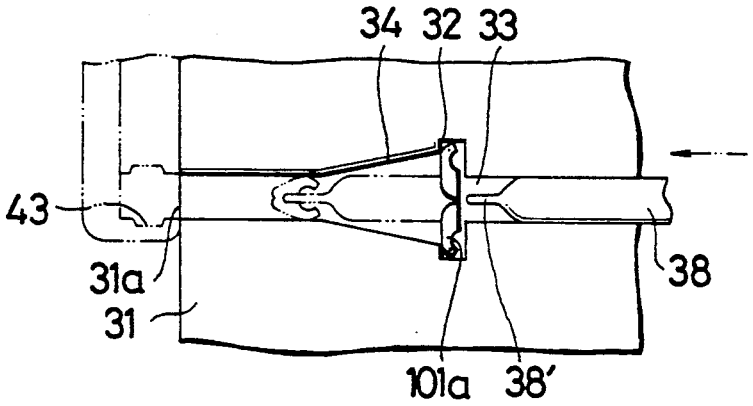
FIG. 6 is a diagrammatic view illustrating the step of bending or folding and transferring the end stop that has been cut.
Figure 7:
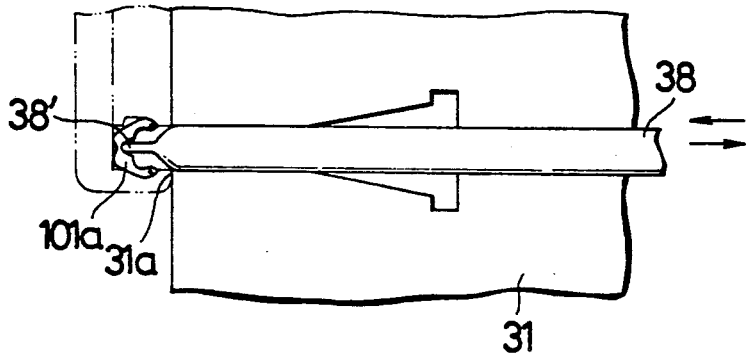
FIG. 7 is a diagrammatic view illustrating the step of moving the folded end stop into an end stop holder.

The transfer finger 35 then moves upward back to its initial position indicated by solid line in FIG. 4 and stands by for the next end stop 101*b*. Designated at 36 is a cutter movable horizontally reciprocally by means of a piston rod 37 along a line registering with the position of the connecting cords 102 of the strip 100 which interconnect the leading end stop 101*a* with the ensuing end stop 101*b* as shown in FIG. 5. The cutter 36 moves forwardly toward and across the guide slit 32 and severs the connecting cords 102, leaving the leading end stop 101*a* in the guide groove 33 of the table 31. The cutter 36 thereafter moves backwardly away from the guide slit 32 and returns to its stand-by position. A pusher rod 38 having a reduced head 38' is movable horizontally reciprocally in and along the guide groove 33. A forward stroke of the pusher 38 causes the head 38' to engage the bridge 105 of the leading end stop 101*a* in the guide groove 33 registering with the guide slit 32 and push the end stop 101*a* forwardly toward the parts applying unit 40 along the tapered guide wall 34, whereupon the end stop 101*a* is progressively folded about its longitudinal axis to bring the opposed legs 103, 103 substantially in superimposed relation to each other as shown in FIG. 6. The leading end stop 101*a* is thus carried further forward until it reaches an outlet end 31*a* of the table 31 at which it is received by the parts applying unit 40 as shown in FIG. 7, whereupon the pusher 38 returns to its stand-by position indicated by solid line in FIG. 6.

The parts applying unit 40 comprises a parts holder 41 located centrally between the oppositely disposed rows of reel stockers 13 and rotatably mounted on a shaft 42. The holder 41 is movable arcuately about 90° toward and away from the path of the stringer chain F, i.e. between a horizontal position in which it receives the end stop 101 and a vertical position in which it transfers the end stop 101 onto the stringer chain F as schematically illustrated in FIG. 2. The parts holder 41 has a pair of pockets 43, 43 each adapted to receive the leading end stop 101*a* from the respective transfer table 31 and may, if desired, includes an additional pocket 44 for receiving the slider S from the slider supply chute 29 as is well known for application concurrently with the end stops 101 onto the stringer chain C. The parts holder 41 is otherwise similar to ones already known and hence no further detailed explanation will be required.

The apparatus 10 thus constructed performs the following cycle of operation associated with one of the paired operating parts which are structurally identical and geometrically symmetrical.

Figure 14:
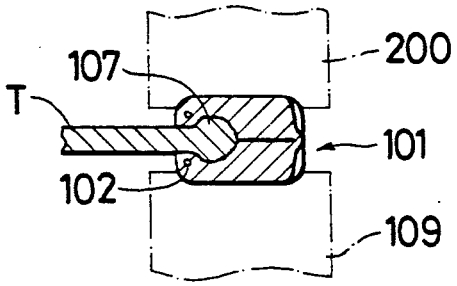
FIG. 14 is a cross-sectional view of the end stop shown attached to the tape.

The piston rod 28 is actuated to move the stocker holder 23 to bring any desired pair of reel stockers 13, 13 selectively over to a position in which the guide channel 22 of the reel stocker 13 registers with the guide slit 32 of the respective transfer table 31. This is followed by advancing movement of the transfer finger 35 to introduce the leading end stop 101*a* through the guide slit 32 onto the transfer table 31 as shown in FIG. 5. The cutter 36 advances and cuts off the leading end stop 101*a* through the connecting cords 102 of the strip 100. The pusher 38 then makes a forward stroke, urging the leading end stop 101*a* to fold during movement along the guide wall 34 in the table 31 as shown in FIG. 6. Upon arrival of the end stop 101*a* at the outlet end 31*a* of the table 31, the parts holder 41 swings upwardly, receives the end stop 101*a* into its pocket 43 and swings downwardly into the path of the stringer chain C, whereupon the end stop 101*a* is mounted with its legs 103, 103 astride the beaded edge 107 of the stringer tape T. Subsequent to return of the parts holder 41 away from the path of the chain C, the end stop 101*a* on the tape T is clamped in place with heat and pressure by the arrangement of a supersonic horn 109 and an anvil 200 as shown in FIG. 14.

Figure 8:
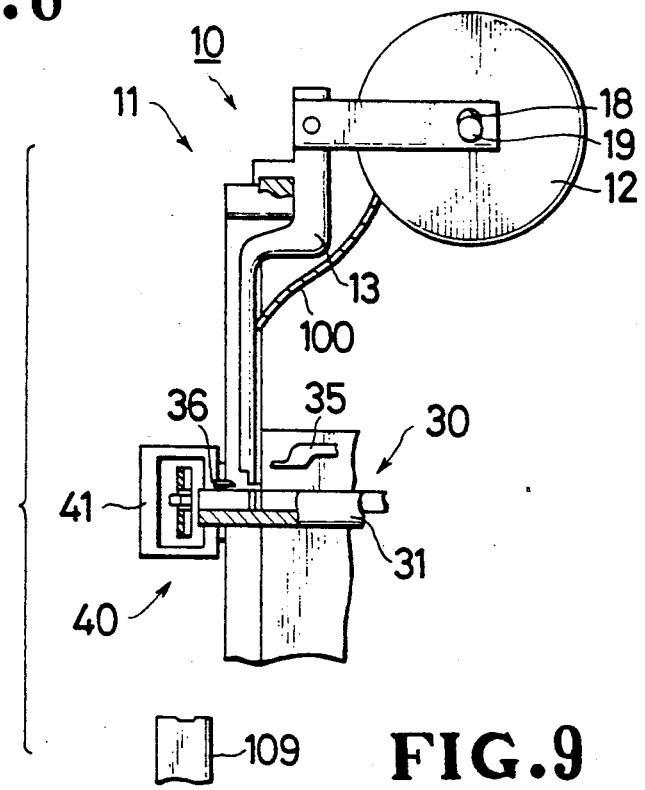
FIG. 8 is a front elevation, partly sectional, view of a portion of apparatus according to another form of the invention.
Figure 9:
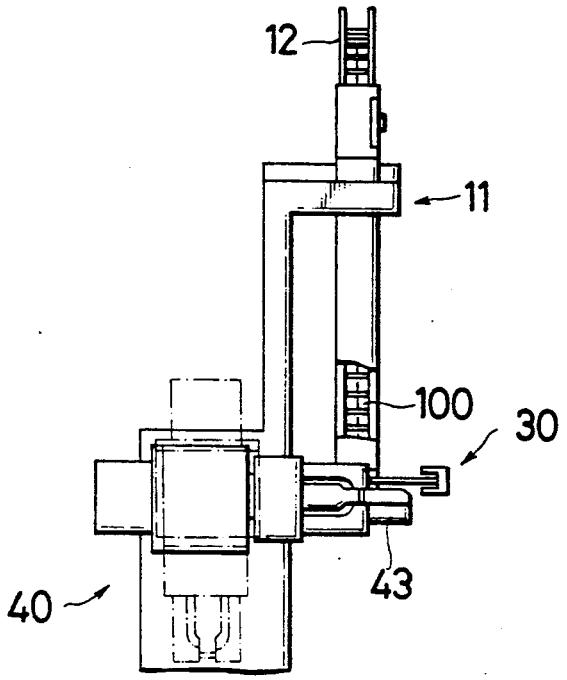
FIG. 9 is a side elevational, partly sectional, view of the apparatus of FIG. 8.
Figure 10:
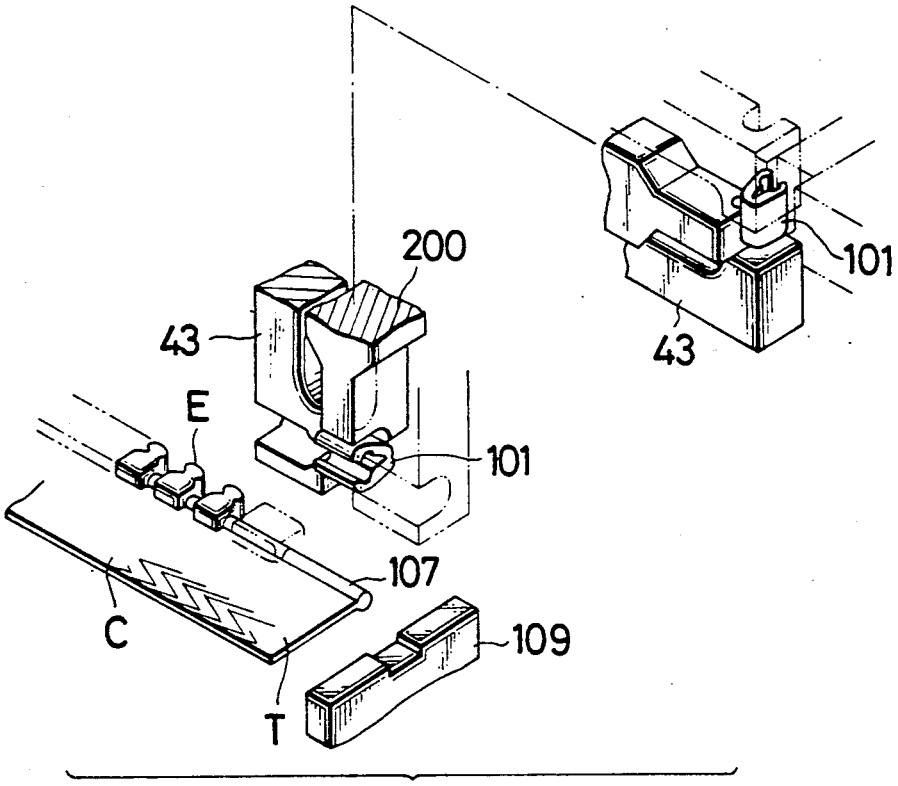
FIG. 10 is a diagrammatic perspective view of a portion of the apparatus of FIG. 8 illustrating the step of applying an end stop to a slide fastener stringer.

FIGS. 8–10 inclusive illustrates a modified embodiment of the invention which provides an apparatus 10*a* comprising a single set of operating units 11, 30 and 40 and designed to feed and apply the end stops 101 one at a time to only one of a pair of stringers F. This arrangement is advantageous in that the apparatus 10*a* is extremely compact and can be expeditiously put to use at the option of garment manufacturers and suppliers who can freely select the style and color of the end stops 101 as stored in the removable reels 12.

Obviously, various modifications and variations of the present invention are possible in the light of the above teaching. It is therefore to be understood that within the scope of the appended claims the invention may be practiced otherwise than as specifically described.

What is claimed is:

1. A method of feeding and applying end stops to a slide fastener chain which comprises the steps of winding upon a cartridge-type reel, an elongated strip formed from a synthetic plastic material and having a succession of serially interconnected prospective end stops and a plurality of flexible connecting cords interconnecting adjacent ones of said end stops in spaced apart relation; advancing said strip by a pitch corresponding to one of the end stops; cutting a leading one of said end stops from said strip across said connecting cords; folding the thus cut leading end stop centrally about its transverse axis; transferring the thus folded leading end stop to an end stop applying station; and clamping the same astride over one longitudinal edge of a slide fastener tape.

2. An apparatus for feeding and applying end stops to a slide fastener chain which comprises (a) a reel stocker unit including at least one reel having wound thereon an elongated strip formed from a synthetic plastic material and having a succession of serially interconnected prospective end stops and a plurality of flexible connecting cords interconnecting adjacent ones of said end stops in spaced apart relation; a reel stocker releasably mounting said reel thereon and having a vertical guide channel for the passage of said strip; a reel stocker holder releasably holding said reel stocker thereon and movable horizontally reciprocally toward and away from a predetermined position;

(b) a transfer table unit including a table having a vertical guide slit dimensioned to receive one end stop from said reel stocker, and a horizontal guide groove communicating with said guide slit and extending longitudinally of said table; a transfer finger reciprocally movable horizontally to engage said connecting cords of said strip and vertically to bring a leading end stop onto said table; a cutter movable reciprocally horizontally for cutting off said leading end stop across said connecting cords; and a pusher movable reciprocally horizontally in and along said guide groove and adapted to cause said leading end stop to fold about its transverse axis;

(c) a parts applying unit including a parts holder movable arcuately toward and away from the path of the slide fastener chain and having a pocket for receiving said end stop, which has been folded, from said table and transfering the same onto the slide fastener chain; and (d) a means of clamping said folded end stop onto a beaded edge of a slide fastener tape with heat and pressure.

3. An apparatus according to claim 2 wherein said table has a tapered guide wall contiguous to said guide slit along which said leading end stop is moved by said pusher to fold progressively about its transverse axis.

4. An apparatus according to claim 2 wherein said means comprises a supersonic horn and an anvil.

5. An apparatus for feeding and applying end stops to a slide fastener chain which comprises (a) a reel stocker unit including a plurality of reels each having wound thereon an elongated strip formed from a synthetic plastic material and having a succession of serially interconnected prospective end stops and a plurality of flexible connecting cords interconnecting adjacent ones of said end stops in spaced apart relation; a plurality of reel stockers each releasably mounting said reel thereon and having a vertical guide channel for the passage of said strip; a pair of reel stocker holders releasably holding said reel stockers thereon symmetrically in horizontally spaced parallel relation and movable horizontally reciprocally toward and away from a predetermined position;

(b) a transfer table unit including a table having a vertical guide slit dimensioned to receive one end stop from said reel stocker, and a horizontal guide groove communicating with said guide slit and extending longitudinally of said table; a transfer finger reciprocally movable horizontally to engage said connecting cords of said strip and vertically to bring a leading end stop onto said table; a cutter movable reciprocally horizontally for cutting off said leading end stop across said connecting cords; and a pusher movable reciprocally horizontally in and along said guide groove and adapted to cause said leading end stop to fold about its transverse axis;

(c) a parts applying unit including a parts holder movable arcuately toward and away from the path of the slide fastener chain and having a pair of pockets each for receiving said end stop, which has been folded, from said table and transfering the same onto the slide fastener chain; and (d) a means of clamping said folded end stop onto a beaded edge of a slide fastener tape with heat and pressure.

6. An apparatus according to claim 5 wherein said parts holder is located between said pair of reel stockers for transferring sliders concurrently with said end stops onto said slide fastener chain.

* * * * *